US007765715B2

(12) United States Patent
Kim

(10) Patent No.: US 7,765,715 B2
(45) Date of Patent: Aug. 3, 2010

(54) DRYING APPARATUS, AND CONTROLLING METHOD OF THE SAME

(75) Inventor: Sang Doo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 960 days.

(21) Appl. No.: 10/584,866

(22) PCT Filed: Oct. 26, 2005

(86) PCT No.: PCT/KR2005/003583

§ 371 (c)(1),
(2), (4) Date: Jun. 28, 2006

(87) PCT Pub. No.: WO2006/046835

PCT Pub. Date: May 4, 2006

(65) Prior Publication Data

US 2009/0172969 A1 Jul. 9, 2009

(30) Foreign Application Priority Data

Oct. 26, 2004 (KR) ..... 10-2004-0085545

(51) Int. Cl.

| | |
|---|---|
| ***F26B 3/02*** | (2006.01) |
| ***F26B 21/08*** | (2006.01) |
| ***F26B 19/00*** | (2006.01) |
| ***D06F 58/04*** | (2006.01) |

(52) U.S. Cl. ..... 34/491; 34/550; 34/562; 34/572; 34/73; 34/88

(58) Field of Classification Search ..... 34/467, 34/468, 487, 491, 550, 562, 572, 72, 73, 34/88

See application file for complete search history.

(56) References Cited

U.S. PATENT DOCUMENTS

| | | | | |
|---|---|---|---|---|
| 5,649,372 | A * | 7/1997 | Souza | 34/491 |
| 6,931,760 | B2 * | 8/2005 | Yang | 34/491 |
| 6,983,552 | B2 * | 1/2006 | Park | 34/549 |

FOREIGN PATENT DOCUMENTS

| | | | |
|---|---|---|---|
| EP | 481442 | A2 * | 4/1992 |

* cited by examiner

*Primary Examiner*—Jiping Lu
(74) *Attorney, Agent, or Firm*—Birch, Stewart, Kolasch & Birch, LLP

(57) ABSTRACT

A drying apparatus and a controlling method thereof are provided. During an initial phase of drying operation according to a selected drying cycle, a point of terminating the drying operation is calculated based on a moisture level sensed by a moisture sensor and a moisture output quantity stored in the storage. Drying is performed up to the calculated point of drying operation termination.

15 Claims, 4 Drawing Sheets

[Fig. 1]
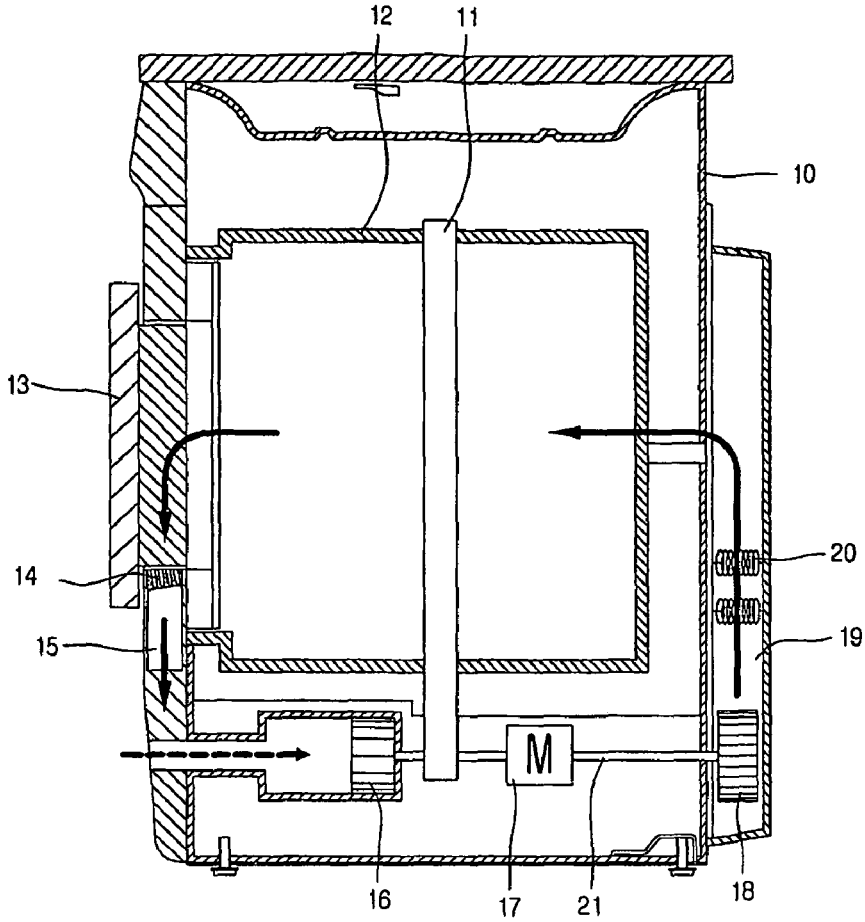
[Fig. 2]
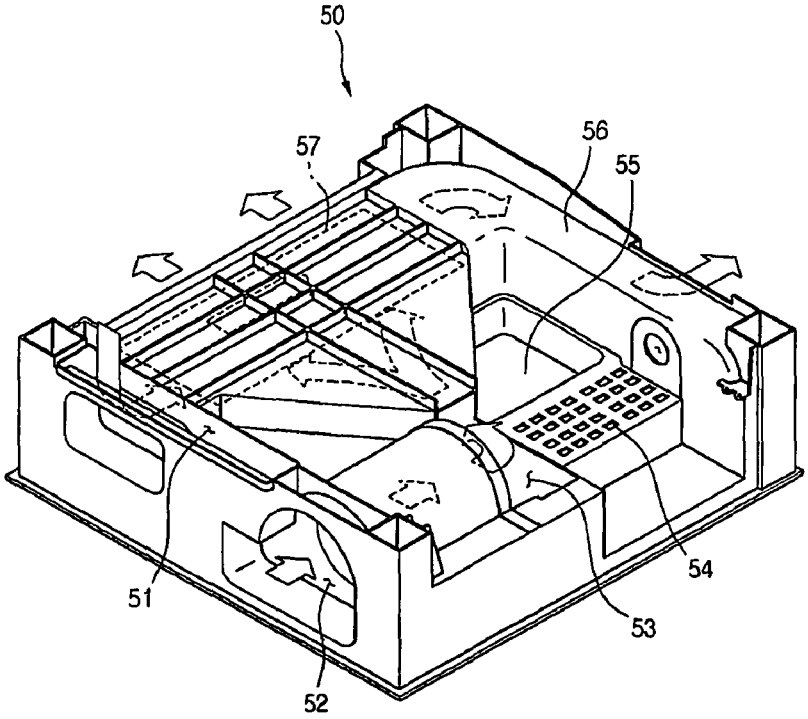

[Fig. 5]
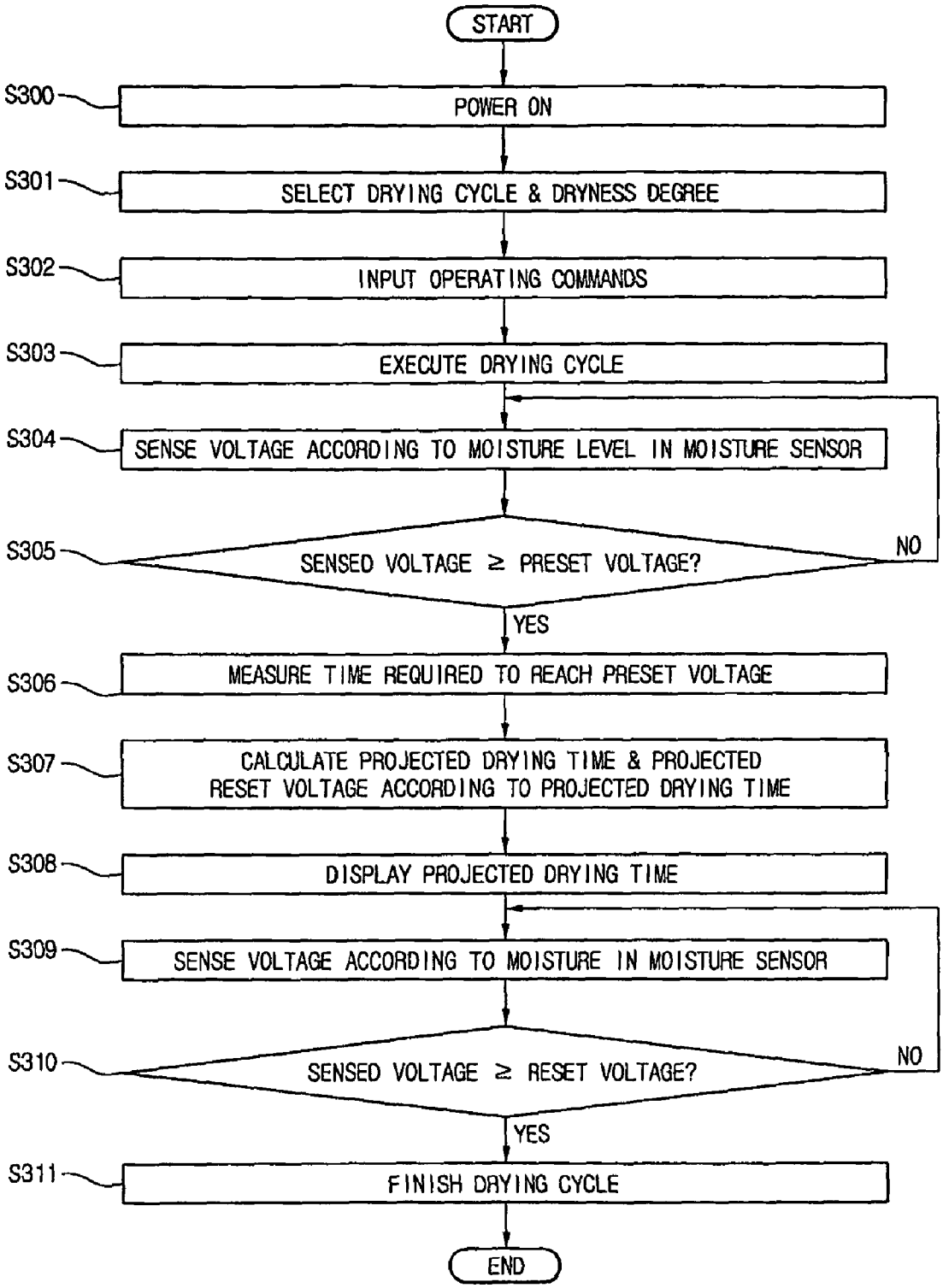

[Fig. 6]
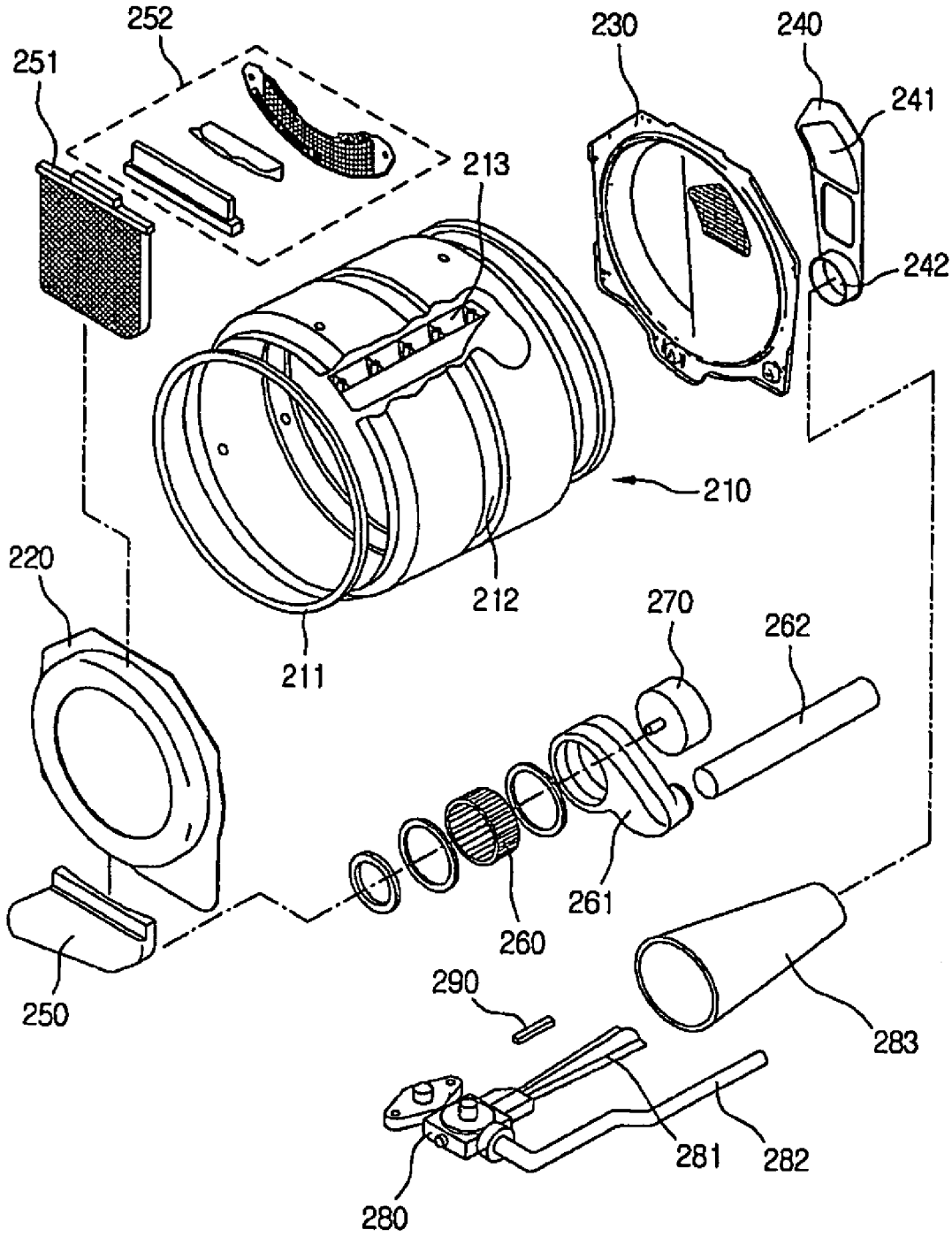

DRYING APPARATUS, AND CONTROLLING METHOD OF THE SAME

TECHNICAL FIELD

The present invention relates to a drying apparatus, and more particularly, to a drying apparatus and a controlling method of the same.

BACKGROUND ART

Washing machines, dryers, and washer/dryer combos utilizing a drum assembly operate using the rotation of the drum. That is, the drum rotates, causing laundry inside to rotate and tumble (rise and fall).

When laundry tumbles inside a washing machine, it collides with wash liquid, causing impurities in the laundry to be removed.

Drum-type dryers have a fan for blowing air heated by an electric heater, gas burner, or other heating device into the drum, where the heated air absorbs moisture from and dries the laundry therein. Dryers are divided into exhaust-type and condenser-type dryers.

Condenser-type dryers have an installed drum for holding laundry. A conventional condenser-type dryer rotates the drum, and senses if the laundry is dry through an electrode sensor installed in a predetermined region of the drum that contacts the laundry. By contacting an article of laundry with two electrodes, the electrode sensor determines its state of dryness by measuring a changing amount of electrical current passing between the electrodes through the laundry.

A difficulty with the above sensing method, however, is that when a small load of laundry is being dried, the laundry may not contact the electrodes because it is stuck to the inner walls of the drum or because it is sparsely dispersed inside the drum. In these cases, obtaining an accurate reading is not possible.

A certain amount of accuracy in determining a termination point of drying laundry was possible with the above-described method. However, when a small load of laundry is dried, the frequency of contact between the electrodes and the laundry is reduced, so that the dryer determines that the laundry is dry and ceases operation when the laundry is in fact not dry, or continues drying the laundry even when the clothes are dry.

An increase in faulty drying cycles causes user dissatisfaction.

DISCLOSURE OF INVENTION

Technical Problem

An object of the present invention is to provide a drying apparatus and a controlling method thereof with an improved sensing ability of laundry dryness, so that the determining of when to end a drying cycle can be accurate.

Technical Solution

In an aspect of the present invention, there is provided a drying apparatus for drying laundry inside a drum thereof, including: a control panel for selecting a drying cycle setting; a storage for storing a moisture output quantity according to the selected drying cycle setting; a moisture sensor for sensing a moisture level in the laundry inside the drum; and a controller for calculating a termination point of drying operation based on the moisture level sensed by the moisture sensor and the moisture output quantity stored in the storage during an initial drying operation according to the drying cycle, and implementing drying until the calculated termination point of drying operation.

In another aspect of the present invention, there is provided a controlling method of a drying apparatus having a drum, a control panel for inputting a drying cycle, a storage for storing a moisture output quantity according to the drying cycle, a moisture sensor, and a controller, the controlling method including: selecting a drying cycle through the control panel; performing an initial drying according to the drying cycle; sensing a moisture level of laundry inside the drum through the moisture sensor during an initial drying operation; calculating, at the controller, a termination point of drying operation based on the sensed moisture level of the laundry and a moisture output quantity stored in the storage corresponding to the selected drying cycle; and implementing drying until the termination point of the drying operation calculated by the controller.

In a further aspect of the present invention, there is provided a controlling method of a drying apparatus having a drum, a control panel for inputting a drying cycle, a storage for storing a moisture output quantity according to the drying cycle, a moisture sensor, and a controller, the controlling method including: selecting a drying cycle through the control panel; performing an initial drying according to the drying cycle; sensing a moisture level of laundry inside the drum through the moisture sensor during an initial drying operation; calculating an elapsed time that the moisture level of sensed laundry takes to reach a set value according to the moisture output quantity stored in the storage from the drying cycle; calculating a projected drying time according to the calculated elapsed time and the selected drying cycle; and implementing a drying operation according to the calculated projected drying time by the controller.

Advantageous Effects

The drying apparatus and the controlling method thereof allow the moisture level to be detected by a moisture sensor, so that the amount of laundry inside the drum can be accurately measured.

In addition, the drying apparatus and the controlling method thereof also allows accurate measuring of a small laundry load to determine a projected drying time thereof.

Further, the drying apparatus and the controlling method thereof calculates a projected drying time based on the laundry load and user specifications, and can determine an accurate point for terminating the drying cycle to increase drying performance.

BRIEF DESCRIPTION OF THE DRAWINGS

FIG. 1 is a schematic sectional view of a drying apparatus according to a first embodiment of the present invention.

FIG. 2 is a perspective view of a base of the drying apparatus according to the first embodiment of the present invention.

FIG. 5 is a flowchart of a controlling method for the drying apparatus according to the first embodiment of the present invention.

FIG. 6 is an exploded perspective view of a drying apparatus according to a second embodiment of the present invention.

BEST MODE FOR CARRYING OUT THE INVENTION

Figure 3:
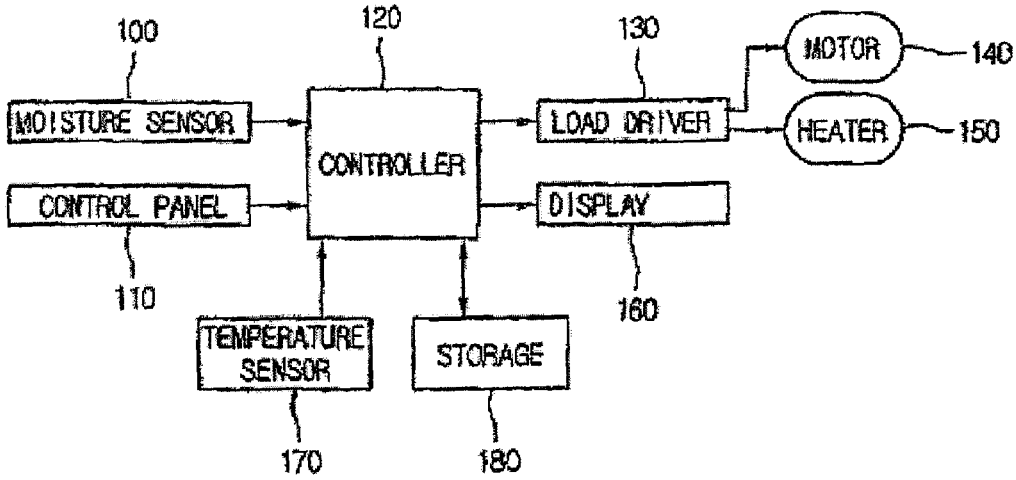
FIG. 3 is a block diagram of the structure of the drying apparatus according to the first embodiment of the present invention.

Reference will now be made in detail to the preferred embodiments of the present invention, examples of which are illustrated in the accompanying drawings. Wherever possible, the same reference numbers will be used throughout the drawings to refer to the same or like parts.

FIG. 1 is a schematic sectional view of a drying apparatus according to a first embodiment of the present invention Referring to FIG. 1, a condenser-type drying apparatus includes a cabinet 10 forming the outer shape of the apparatus, a cylindrical drum 12 formed inside the cabinet 10, a door 13 controlling the opening and closing of the drum 12, and a belt 11 wrapped around the outer surface of the drum 12.

A motor shaft 21 is connected to the belt 11, a motor 17 is connected to the motor shaft 21 to impart a rotating force thereto, and a cooling fan 16 is connected to the motor shaft 21 and rotates by the rotating force from the motor 17 to suction indoor air.

Also, a drying fan 18 for circulating air inside the drum 12 is connected to the motor shaft 21 opposite the cooling fan 16. A drying duct 19 having a radiating portion 20 provides a passage for air suctioned by the drying fan 18 to move into the drum 12.

The lower end of the opening for inserting the door 13 into includes a lint filter 14 formed thereon for removing lint and other impurities from moist air exhausted from the drum. The air that passes through the lint filter 14 moves to a condenser 57 (shown in FIG. 2) through a further included circulating duct 15. The drying fan 18, the drying duct 19, the radiating portion, the lint filter 14, the condenser 57, and the circulating duct 15 can all be defined as a condenser.

In this embodiment, a moisture sensor (not shown) for sensing the moisture level of laundry inside the drum 12 is installed in the condenser. The moisture sensor may be disposed between the drying fan 18 and the radiating portion 20.

An operation of the drying apparatus will be described below.

First, when power is applied to the drying apparatus, the motor 17 rotates and the heater 20 attached on the inner wall of the drying duct 19 operates. The belt 11 attached to the motor shaft 21 rotates to turn the drum 12.

The rotation of the drum 12 prompts the laundry inside the drum to rise along the inner wall of the drum in accordance with its rotation, and fall by means of gravity when it reaches the apex. Here, the laundry is lifted by lifting ridges (not shown) formed on the inner walls of the drum.

The drying fan 18 attached to the motor shaft 21 operates when the motor 17 rotates, suctioning circulating air through the lint filter 14. The suctioned air rises through the drying duct 19, and becomes hot, dry air after passing the heater. This hot, dry air passes through the inside of the drum and absorbs moisture from the laundry inside, to become hot, moist air.

Moreover, the hot, moist air passes through the lint filter 14 again to be filtered, and passes through the circulating duct 15 to the condenser 57.

The cooling fan 16 connected to the motor shaft 21 rotates to suction indoor air into the drying apparatus. The suctioned interior air passes by the cooling fan 16 to the condenser 57. The interior air that passes to the condenser 57 exchanges heat with the hot, moist air that passes through the circulating duct 15, forming condensed water, and will be described below in further detail.

FIG. 2 is a perspective view of a base of the drying apparatus according to the first embodiment of the present invention.

Referring to FIG. 2, the base 50 of the drying apparatus includes: a circulating air descending portion 51 in which the interior air that passes through the lint filter 14 from the drum 12 descends, an entrance formed at the bottom end of the circulating air descending portion 51, a condenser 57 extending to the rear of the base 50, and a circulating air passage 56 formed at the rear of the condenser 57 for the air that passed through the condenser 57 to pass through.

At the right side of the front surface of the base 50, an interior air intake port 52 is provided to suction interior air and a cooling fan receptacle 53 is provided to receive the cooling fan that suctions interior air.

Behind the cooling fan receptacle 53, a motor is stationed to impart force to rotate the drum of the drying apparatus, and a motor heat radiating hole 54 is provided to radiate heat generated by the motor.

A condensed water reservoir 55 is provided at the approximate center of the base 50 and collects water condensed by the condenser 57.

A flow of liquid within the base 50 will be described below in brief.

As described above, the interior air that becomes hot and moist after passing through the inside of the drum 12 passes through the lint filter 14 formed at the lower end of the opening for the door, and passes the circulating air descending portion 51 and then the condenser 57. The interior air that is suctioned through the interior air intake port 52 passes the cooling fan and flows through the condenser 57.

Here, because the interior air has a lower temperature than the circulating air, heat exchange occurs while it passes through the condenser 57.

Specifically, in order for the circulating air passing the condenser 57 and the interior air to not mix and only exchange heat, the interior of the condenser 57 is structured to have a circulating air passage intersecting with, but separate from an interior air passage.

The circulating air passing the condenser 57 flows through the circulating air passage 56 to the drying duct 19 formed at the rear wall of the dryer. The interior air passing the condenser 57 is re-introduced into the interior.

Here, the moisture level of the laundry inside the drum 12 is determined through the moisture sensor. The detected moisture level is used to calculating an accurate terminating point for the drying cycle.

Figure 4:
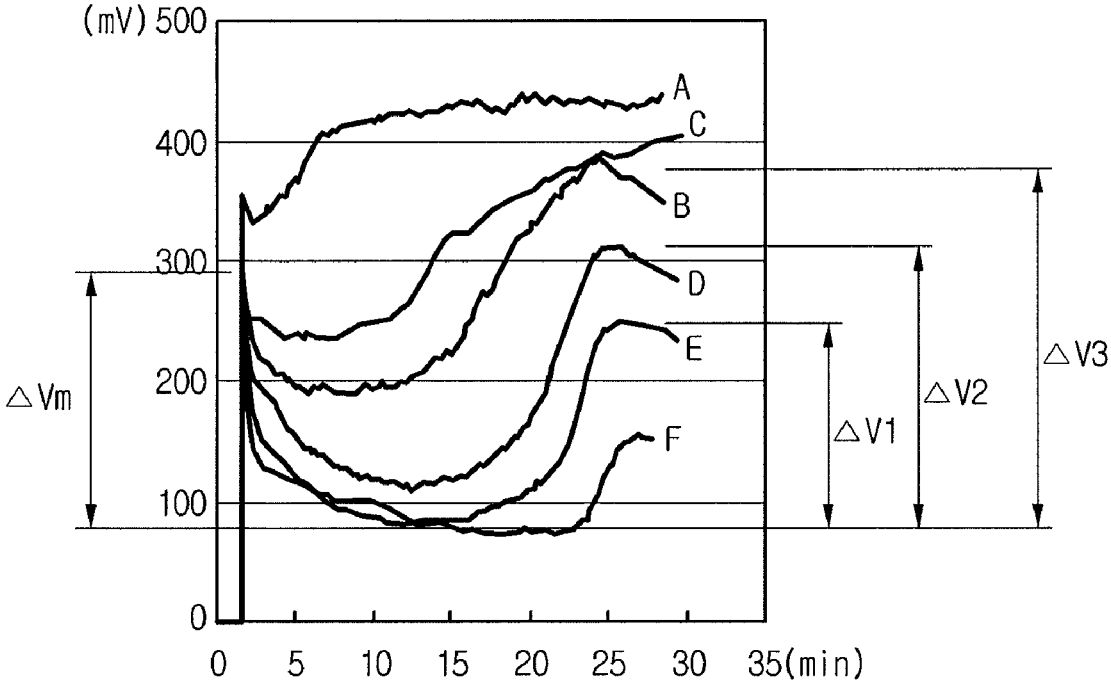
FIG. 4 is a graph showing a changing voltage level sensed by the moisture sensor shown in FIG. 3 over time.

FIG. 3 is a block diagram of the structure of the drying apparatus according to the first embodiment of the present invention, FIG. 4 is a graph showing a changing voltage level sensed by the moisture sensor shown in FIG. 3 over time, and FIG. 5 is a flowchart of a controlling method for the drying apparatus according to the first embodiment of the present invention.

The drying apparatus according to the embodiment of the present invention, as shown in FIG. 3, includes: a moisture sensor 50 installed in a predetermined region of the condenser for sensing a moisture level in the laundry to be dried; a control panel 110 for inputting user-specified drying cycle settings and level of dryness; a storage 190 for storing a moisture output quantity according to the user-inputted drying cycle settings; a controller 120 for determining the time it takes for a voltage sensed by the moisture sensor 50 to reach a preset voltage, and the moisture output quantity according to the user-inputted drying cycle settings, after initial drying is implemented, and for implementing a drying cycle in accordance to a projected drying time; a load driver 130 for driving a motor 140 and a heater 150 according to a control signal from the controller 120; a temperature sensor 170; and a display 160 for displaying the calculated projected drying time and operating status according to a control signal from the controller 120.

Here, the moisture sensor 50 may be a moisture sensor. The moisture sensor is a relative and/or absolute moisture sensor that is able to directly sense moisture level in air.

The operation of the above-described drying apparatus according to the present invention will be described in the following.

First, a user turns the power on in step S300 through the control panel 110, inputs a desired dryness level and drying cycle in step S301, and presses a start button in step S302, beginning a drying cycle in step S303. Here, the moisture sensor 50 senses the moisture output quantity of the laundry. Specifically, the moisture sensor 50 senses a voltage corresponding to the moisture output quantity from the laundry to sense the amount of laundry in step S304.

Next, the controller 120 compares the sensed voltage from the moisture sensor 50 to a preset voltage ΔVm in step S305. In the compared results, if the sensed voltage is greater than or equal to the preset voltage, immediately after the initial drying operation, the time it takes for a preset voltage to be reached is determined in step S306. On the other hand, if the compared results show the sensed voltage to be lower than the preset voltage, the moisture sensor 50 continues to sense the moisture level.

The time it takes to reach the sensed preset voltage is applied to a preset formula (below), to calculate a projected drying time in step S307. Here, if the preset voltage ΔVm is a minimum value sensed when the load is minimal.

Also, the calculated projected drying time is displayed in the display 160 in step S308, allowing the user to easily assess how much longer the drying will take. The controller 120 determines the termination point of drying operation according to the calculated projected drying time and the user-inputted drying cycle, and outputs a control signal to the load driver 130 to implement a relevant drying cycle accordingly.

That is, in the case of drying one towel (as shown by line A), representing a minimal sensed load, a projected termination point is calculated, based on the time it takes to sense a minimum voltage ΔVm and the user's selected drying cycle.

Accordingly, the time it takes to reach the preset voltage ΔVm is 15 minutes in the case of drying three towels (as shown by line B), 20 minutes in the case of drying five towels (as shown by line C), and 25 minutes in the case of drying seven towels (as shown by line D). Thus, as the load increases, so does the time it takes to reach the set voltage.

A predetermined formula for calculating the projected drying time is expressed as $$\text{ProjectedDryingTime}=(K1*\text{MeasuredTime}(DT)*\Delta Vm)+(K2*\Delta Vx*\Delta Vm)$$

where K1 and K2 are constants, the measured time DT is the sensing time it takes to reach a preset voltage ΔVm, and ΔVx is a voltage set dependent on the drying cycle selected by a user. That is, the moisture output quantity is ordered by cotton>nylon>lingerie>sportswear, and ΔVx is accordingly set as ΔVx1>ΔVx2>ΔVx3>ΔVx4. ΔVx1>ΔVx2>ΔVx3>ΔVx4 are preset data values in the storage 180.

The voltage corresponding to the projected drying time is reset as the set voltage.

The drying cycle is implemented according to the calculated projected drying time, and the moisture sensor 100 senses a voltage according to the moisture level in laundry in step S309. The sensed voltage is compared to the reset voltage corresponding to the projected drying time in step S310.

When the results show that the sensed voltage is equal to or greater than the reset voltage, the drying cycle is terminated in step S311. Then, the drying cycle of the laundry inside the drum 12 is complete. However, when the sensed voltage is smaller than the reset voltage, the moisture sensor 100 continues to monitor the moisture-level of the laundry.

The above-described condensing-type drying apparatus and its controlling method according to the present invention have the following effects.

First, a moisture sensor for accurately sensing a comparative moisture level is installed in the condenser, so that the load of laundry in the drum can be accurately gauged.

Second, even when the load of laundry is small, a projected drying time can be calculated.

Third, by calculating and displaying the projected drying time based on the size of the load and the user's specifications, an accurate termination point of drying operation can be determined, and drying effectiveness increases accordingly.

Mode For The Invention

A second embodiment of the present invention will be described below with reference to FIG. 6. In the description below, parts repetitive of the above-described first embodiment are thereby enclosed and thus omitted below.

FIG. 6 is an exploded perspective view of a drying apparatus according to a second embodiment of the present invention.

An exhaust-type drying apparatus is illustrated in FIG. 6. An exhaust-type drying apparatus includes a drum 210 for putting laundry in, a front head 220 attached to the front opening of the drum 210 for supporting the front vertical hem of the drum 210, a rear head 230 attached at the rear opening of the drum 210 for sealing and simultaneously supporting the rear vertical hem of the drum 210, and a drying duct 240 installed at the bottom of the rear head 230 for supplying hot air.

In further detail, the outer surface of the drum 210 has a belt groove for accommodating a rotating belt (not shown) connected to a motor 270 for rotating the drying drum. Also, the front and rear vertical hems of the drum 210 have a seal 211 inserted between the front head 220 and the rear head 230 to prevent air inside the drum 210 from leaking. One or more of a lifting ridge 213 for lifting the laundry within the drum 210 is installed in the drum 210.

Additionally, the inner bottom of the front head 220 has a lint filter 251 installed therein for filtering lint from the laundry during drying. The drum also has an exhaust assembly 252 for expelling air from the front portion of the drum 210, a lint duct 250 communicating with the exhaust assembly 252 and guiding air that has impurities removed therefrom as it flows through the lint filter 251, a blower 260 connected to the rear of the lint duct 250 and to the motor 270 for suctioning air inside the drum 210, a blower housing 261 for housing the blower 260, an exhaust duct 262 for exhausting air that passes through the blower housing 261 to the outside, and a motor for driving the blower 260.

A moisture sensor (not shown) is installed inside the exhaust duct 262. The moisture sensor senses the moisture level of hot, moist air that flows through the exhaust duct 262, and sends the collected data to the controller. With the sensed moisture level data, the controller calculates a projected drying time, and implements a drying cycle accordingly.

Additionally, in order to increase the temperature of the air entering the drum 210, a gas supply line 282 for supplying gas to a heating device, a gas nozzle 280 for dispensing gas supplied from the gas supply line 282, a mixing line 281 for mixing the gas discharged from the gas nozzle 280 with air, an igniter 290 for igniting the gas discharged from the gas nozzle 280, and a hot air duct 283 for guiding the heat (created when the gas is ignited by the igniter 290 and burns) to the drying duct 240, are provided.

In further detail, an entrance portion 242 connected to the hot air duct 283 is formed at the bottom of the drying dust 240 to receiving hot, dry air blown from the hot air duct 283. At the upper portion of the drying duct 240, an exhaust portion 241 is formed for allowing the hot air that flows through the entrance portion 242 to flow into the drum 210. The mixing line 281 is formed to extend a predetermined distance into the hot air duct 283. The gas nozzle 280 has a valve to control the supply of gas.

An operation of the above-described drying apparatus according to the present invention will be described below.

First, a user inserts wet laundry into the drum 210 and closes the door. Next, the user presses the start button to begin the supply of gas through the gas supply line 282. The motor 270 operates and spins the blower 260. When the blower 260 spins, outside air enters the inside of the hot air duct 283. Then the valve of the gas nozzle 280 opens to dispense gas through the gas nozzle 280, and a portion of the air that enters the hot air duct 283 is proportioned into the mixing line 281. The outside air that enters the mixing line 281 and the gas discharged from the gas nozzle 280 mix. Then a spark for firing the igniter 290 is discharged, and the gas-air mixture burns and gives off heat.

The air that is heated by the burning mixture flows through the hot air duct 283 into the drying duct 240. The air that enters the drying duct 240 flows into the drum 210. The hot, dry air that enters the drum 210 becomes hot, moist air as it circulates through the drum 210, absorbing moisture from laundry therein.

Additionally, the air that has become hot and moist inside the drum 210 is discharged to the outside of the drum 210 and passes through the lint filter 251, exhaust assembly 252, and the lint duct 250. The air that is discharged through the lint duct 250 is suctioned by the blower 260, and is discharged to the inside through the blower housing 261 and the exhaust duct 262 connected to the blower housing 261.

The moisture from the air passing through the exhaust duct 262 is sensed by the moisture sensor, and the sensed signal is sent to the controller. Then, the controller calculates a projected drying time as in the first embodiment, using the sensed moisture level data, and implements a drying cycle.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

The drying apparatus and the controlling method thereof according to the present invention improves the effectiveness of a drying cycle for a high industrial applicability.

The invention claimed is:

1. A drying apparatus for drying laundry inside a drum thereof, comprising:

a control panel for selecting a drying cycle setting;

a storage for storing a moisture output quantity according to the selected drying cycle setting;

a moisture sensor for sensing a moisture level in the laundry inside the drum; and a controller for calculating a termination point of drying operation based on the moisture level sensed by the moisture sensor and the moisture output quantity stored in the storage during an initial drying operation according to the drying cycle, and implementing drying until the calculated termination point of drying operation, wherein the controller calculates an elapsed time that the moisture level of sensed laundry takes to reach a set value according to the moisture output Quantity stored in the storage from the drying cycle; then calculates the termination point of drying operation according to the calculated elapsed time and the selected drying cycle, and wherein the elapsed time is a time that the stored output Quantity takes to reach a minimum sensed value during a drying of a small load.

2. The drying apparatus according to claim 1, wherein the controller calculates the termination point of drying operation by comparing a voltage according to the moisture output quantity with a voltage corresponding to the moisture level sensed by the moisture sensor.

3. The drying apparatus according to claim 1, wherein the moisture sensor is a humidity sensor.

4. The drying apparatus according to claim 1, further comprising a condenser for condensing moisture from laundry, the moisture sensor being disposed in the condenser.

5. The drying apparatus according to claim 1, further comprising an exhaust duct for communicating the drum with an outside of the drying apparatus, the moisture sensor being disposed in the exhaust duct.

6. The drying apparatus according to claim 1, further comprising a display for displaying a projected drying time based on the termination point for drying operation calculated by the controller.

7. A controlling method of a drying apparatus having a drum, a control panel for inputting a drying cycle, a storage for storing a moisture output quantity according to the drying cycle, a moisture sensor, and a controller, the controlling method comprising:

selecting a drying cycle through the control panel;

performing an initial drying according to the drying cycle;

sensing a moisture level of laundry inside the drum through the moisture sensor during an initial drying operation;

calculating, at the controller, a termination point of drying operation based on the sensed moisture level of the laundry and a moisture output quantity stored in the storage corresponding to the selected drying cycle; and implementing drying until the termination point of the drying operation calculated by the controller, wherein the calculating, at the controller, a termination point of drying operation includes calculating an elapsed time that the moisture level of sensed laundry takes to reach a set value according to the moisture output quantity stored in the storage from the drying cycle; and calculating the termination point of the drying operation according to the calculated elapsed time and the selected drying cycle, wherein the elapsed time is a time that the stored output quantity takes to reach a minimum sensed value during a drying of a small load.

8. The controlling method according to claim 7, wherein the calculating of the termination point of the drying operation includes comparing, at the controller, a voltage corresponding to the moisture output quantity stored in the storage with a voltage corresponding to the moisture level sensed by the moisture sensor.

9. The controlling method according to claim 7, further comprising calculating a projected drying time based on the termination point of the drying operation calculated by the controller.

10. The controlling method according to claim 9, wherein the drying until the termination point of drying operation is implemented by the controller according to the projected drying time.

11. The controlling method according to claim 9, wherein the projected drying time is calculated by a sum of a multiplied value of a first constant K1, a DT (default time), and a preset voltage ΔVm and a multiplied value of a second constant K2, a preset voltage ΔVm, and a voltage ΔVx set according to the drying cycle.

12. A controlling method of a drying apparatus having a drum, a control panel for inputting a drying cycle, a storage for storing a moisture output quantity according to the drying cycle, a moisture sensor, and a controller, the controlling method comprising:

selecting a drying cycle through the control panel;

performing an initial drying according to the drying cycle;

sensing a moisture level of laundry inside the drum through the moisture sensor during an initial drying operation;

calculating an elapsed time that the moisture level of sensed laundry takes to reach a set value according to the moisture output quantity stored in the storage from the drying cycle;

calculating a projected drying time according to the calculated elapsed time and the selected drying cycle; and implementing a drying operation according to the calculated projected drying time by the controller, wherein the elapsed time is a time that the stored output quantity takes to reach a minimum sensed value during a drying of a small load.

13. The controlling method according to claim 12, further comprising displaying the projected drying time.

14. The controlling method according to claim 12, wherein the projected drying time is calculated by a sum of a multiplied value of a first instant K1, a DT (default time), and a preset voltage ΔVm and a multiplied value of a second constant K2, a preset voltage ΔVm, and a voltage ΔVx set according to the drying cycle.

15. The controlling method according to claim 12, wherein the calculating of the elapsed time includes comparing, at the controller, a voltage corresponding to a moisture output quantity stored in the storage with a voltage corresponding to a moisture level sensed by the moisture sensor.

* * * * *